US007686471B2

(12) United States Patent
Reichow

(10) Patent No.: US 7,686,471 B2
(45) Date of Patent: Mar. 30, 2010

(54) STANDALONE FLAME SIMULATOR

(75) Inventor: Mark A. Reichow, Valencia, CA (US)

(73) Assignee: Disney Enterprises, Inc., Burbank, CA (US)

( * ) Notice: Subject to any disclaimer, the term of this patent is extended or adjusted under 35 U.S.C. 154(b) by 145 days.

(21) Appl. No.: 11/558,558

(22) Filed: Nov. 10, 2006

(65) Prior Publication Data

US 2008/0112154 A1 May 15, 2008

(51) Int. Cl.

| | |
|---|---|
| ***F21V 35/00*** | (2006.01) |
| ***F21L 19/00*** | (2006.01) |
| ***F23D 3/16*** | (2006.01) |
| ***G09F 19/00*** | (2006.01) |
| ***A63J 5/02*** | (2006.01) |

(52) U.S. Cl. ..... 362/161; 362/810; 362/569; 362/392; 362/447; 40/428; 472/65

(58) Field of Classification Search ..... 362/161–163, 362/810, 569, 392, 447, 96; 40/428; 472/65
See application file for complete search history.

(56) References Cited

U.S. PATENT DOCUMENTS

| | | | | |
|---|---|---|---|---|
| 3,395,475 | A * | 8/1968 | Moss | 40/428 |
| 4,026,544 | A | 5/1977 | Plambeck et al. | |
| 5,707,282 | A | 1/1998 | Clements et al. | |
| 6,312,137 | B1 * | 11/2001 | Hsieh | 362/96 |
| 6,454,425 | B1 * | 9/2002 | Lin | 362/96 |
| 6,454,441 | B1 * | 9/2002 | Lin | 362/294 |
| 6,757,487 | B2 | 6/2004 | Martin et al. | |
| 6,953,401 | B2 | 10/2005 | Starr | |
| 6,955,440 | B2 | 10/2005 | Niskanen | |
| 7,080,472 | B2 | 7/2006 | Schroeter et al. | |
| 7,093,949 | B2 | 8/2006 | Hart et al. | |

(Continued)

FOREIGN PATENT DOCUMENTS

GB 2434441 A * 7/2007

OTHER PUBLICATIONS

Lens. (2009). In Merriam-Webster Online Dictionary. Retrieved Apr. 22, 2009, from http://www.merriam-webster.com/dictionary/lens.*

(Continued)

*Primary Examiner*—Jong-Suk (James) Lee
*Assistant Examiner*—David J Makiya
(74) *Attorney, Agent, or Firm*—Marsh Fischmann & Breyfogle LLP; Kent A. Lembke

(57) ABSTRACT

An apparatus for simulating flames using fabric flame sheets or elements. The apparatus includes a fan or blower for producing a volume of air flow and two or more flame elements positioned in the fan air flow. First and second light sources, such as high powered light emitting diodes (LEDs), are provided to produce light beams having two differing colors such as an amber beam and an orange/red beam. The light beams are directed so as to mix or cross on or near the flame elements when the flame elements extend outward from their mounting location into the fan air flow. Each of the LEDs has a brightness level that can be tuned or adjusted by a controller, which may be manual or may be automated to modify the brightness level of at least one of the LEDs and typically both LEDs during the operation of the flame simulator.

20 Claims, 8 Drawing Sheets

U.S. PATENT DOCUMENTS

| | | | | |
|---|---|---|---|---|
| 7,111,421 | B2 | 9/2006 | Corry et al. | |
| 7,125,142 | B2 * | 10/2006 | Wainwright | 362/231 |
| 2002/0080601 | A1 * | 6/2002 | Meltzer | 362/96 |
| 2002/0152655 | A1 * | 10/2002 | Merrill et al. | 40/428 |
| 2003/0041491 | A1 * | 3/2003 | Mix | 40/428 |
| 2003/0053305 | A1 * | 3/2003 | Lin | 362/96 |
| 2004/0060213 | A1 * | 4/2004 | Schroeter et al. | 40/428 |
| 2004/0165374 | A1 * | 8/2004 | Robinson | 362/96 |
| 2005/0285538 | A1 | 12/2005 | Jaworski et al. | |
| 2006/0023443 | A1 * | 2/2006 | Connelly et al. | 362/161 |
| 2006/0034100 | A1 | 2/2006 | Schnuckle et al. | |
| 2006/0099565 | A1 * | 5/2006 | Rosserot | 434/365 |
| 2006/0101681 | A1 | 5/2006 | Hess et al. | |
| 2007/0291470 | A1 * | 12/2007 | Thomson | 362/96 |

OTHER PUBLICATIONS

Vaughn Safety, Inc., product catalogue, littlebrightlights.com, Oct. 20, 2006.

Notification of Transmittal of the International Search Report and the Written Opinion of the International Searching Authority, or the Declaration, International Appl. No. PCT/US07/81666, Date of Mailing: May 7, 2008.

* cited by examiner

STANDALONE FLAME SIMULATOR

BACKGROUND OF THE INVENTION

1. Field of the Invention

The present invention relates, in general, to special effect devices and systems and residential theme lighting products that imitate or simulate flames from an actual fire, and, more particularly, to a flame simulator that produces realistic flame effects with flowing air, fabric flame elements, and multiple light sources with reduced heat, with reduced maintenance requirements, and as a standalone unit, i.e., a device that continues to operate unaided once it is switched on or is powered.

2. Relevant Background

There are many applications and uses for devices that simulate fire or the flames of a fire. For example, simulated flame devices or flame simulators are used in amusement parks to provide desired lighting and to create the illusion to people on a ride that they are passing fire. Simulated flames and fire are used in place of real fire to address safety and maintenance concerns. The flame simulators may be provided as burning logs, torches held by ride characters or mounted on walls, and in many other situations. Additionally, there is a growing trend toward the use of flame simulators in residential settings such as outdoor theme lighting, imitation logs burning in a fireplace, and the like.

A number of challenges face the designer of a flame simulator. There is a demand that the flame be realistic even from relatively short distances. Homeowners, amusement park operators, and other users also require that the flame simulators be very safe to use, be easy to maintain, and be relatively inexpensive. Existing flame simulators have not been able to effectively address all of these requirements, and there is a continuing demand for improved ways of producing a flame special effect.

One type of flame simulator uses a silk flame element that is illuminated by a light source. To make the effect more realistic, air current or flow from a fan is directed over the flame element that can make produced "flame" appear to flicker. Unfortunately, there are a number of problems with using silk flame simulators especially in applications that require many hours of service such as in amusement parks and in outdoor residential and commercial lighting fixtures. Typical silk flame simulators use incandescent lighting to illuminate the flame elements. The bulbs have fairly short lives and need to be replaced regularly. Also, incandescent bulbs or lamps produce significant amounts of heat that may result in fire hazards and, at the least, results in safety hazards as the simulator housing the incandescent bulb or lamp becomes very hot. Hence, the heat must be removed and/or the simulator has to be positioned in locations where it will not be contacted by people and flammable materials.

In addition to unwanted heat, silk flame simulators often use fans or blowers that are noisy, which may ruin the fire effect (e.g., the simulator will not sound like a real fire). The fans or blowers often also move a large volume of air over the flame element, and this may cause the flame element to move unrealistically and/or cause air currents near the device that tend to spoil the desired fire simulation. The flame elements themselves are also often not very realistic in their shape or in their pattern of movement. For example, a single flame element or sheet is used that may be heavy and shaped in a pattern that does not move like a real flame or look like a flame when illuminated. Often, the flames are simply cut out in a pattern that leaves exposed threads or edges, which unravel or fray as the elements flap in the high volume air current produced by the fan. The effect achieved also rapidly deteriorates, and the flame elements have to be replaced often. The replacement of the flame elements can also cause problems as the flame elements are often attached in a manner that makes their replacement subjective to the person installing the new flame. As a result, the original orientation of the flame elements may not be produced as the flame elements are positioned in a new location or orientation, which often results in a much different visual effect that generally is not the one intended by the designer of the simulator. Yet another problem with many flame simulators, including silk flame simulators, is the amount of extra unwanted light that passes by the flame (i.e., blow-by). Blow-by is a particular problem in dark, enclosed areas such as ride tunnels or chambers and can essentially destroy the overall look of the flame illusion that is produced by the flame simulator.

There continues to be a demand for innovative flame simulators. Preferably, such flame simulators will be easy to maintain, will produce less heat, will be inexpensive to manufacture, and will produce improved visual effects (i.e., more accurately represent flames of a fire to an observer).

SUMMARY OF THE INVENTION

The present invention addresses the above problems by providing flame simulators with improved longevity, reduced maintenance requirements, safer operations, and significantly improved flame effects. Flame simulators of the present invention generally use two or more light emitting diodes of differing colors to achieve a desired color as the beams from the LEDs are mixed or cross on a number of fluttering or waving flame elements. Each of the LEDs may be manually tuned to have a particular brightness level or may be controlled by a programmable controller that acts to automatically wash or move the LEDs' brightness levels through a range of brightness levels. One or more additional light sources such as LEDs may be provided to create a spark or pop effect, and these LEDs may be controlled in more of a strobe or flashing manner such as by being controlled to operate for brief time periods (e.g., less than a second) periodically or randomly during the operation of the flame simulator. The flame elements in some embodiments are fabricated from white silk fabric with a body that has a wider base and narrower tip with a twist provided by including recessed surfaces or curves on opposite sides of the flame body. Longevity of the flame elements are increased in some cases by cutting the flame bodies from silk sheets with a laser to sear or fuse the threads in the edge, and the edge may further be treated with fray blocking material. Since the flame element body is often formed of a lightweight fabric, the flame simulators may use lower capacity (and quieter) fans such as computer fans or the like with an output of 50 cubic feet per minute (cfm) or less. Straight or diffused flow may be more desirable, and a flow chimney or manifold may be provided at the outlet of the fan and include a diffuser or an airflow straightener. The flame elements are typically mounted, such as with metallic mounting rods attached to their base, to the top or outlet edge of the flow chimney to place the lame elements within the air flow of the fan. The flame simulators of the present invention may be used as standalone devices or may further be incorporated in other structure to produce a particular effect such as a torch, a burning fireplace, or the like and are useful for commercial and for residential applications.

More particularly, an apparatus is provided for simulating flames of a fire. The apparatus includes a fan or blower for producing a volume of air flow. In some cases, the fan is a computer fan with a capacity of less than about 50 cfm. The apparatus also includes two or more flame elements positioned in the fan air flow. First and second light sources are provided to produce light beams having two differing colors such as an amber beam and an orange/red beam. The light sources may be LEDs, such as high powered LEDs (i.e., 2 to 3 Watt or the like LEDs) and typically have their beams directed so as to mix or cross on or near the flame elements as the extend outward from their mounting location into the fan air flow. In some embodiments, each of the LEDs has a brightness level that can be tuned or adjusted by a controller. This controller may be manual or it may be automated to modify the brightness level of at least one of the LEDs and typically both LEDs during the operation of the flame simulator. For example, the controller may run a flame simulation routine that determines a cyclical pattern or random timing and brightness levels, and the controller responds to move the brightness level of one or both the LEDs concurrently or separately through a range of brightness levels. The flame simulator may further include a third light source such as an additional LED that the controller only operates intermittently to create a flashing or strobing effect, e.g., the controller causes the additional light source to flash on for less than a second in a random manner or in a cyclical pattern. To control blow-by, the light sources may include lenses to shape or focus the light beams into beams with patterns with cross sections that have a size smaller than about the size of the flame elements in the fan air flow (e.g., an oval lens may be used to create an oval cross section beam that has a cross sectional area where it contacts the flame elements that is smaller than or about the same size as the flame bodies).

The flame simulators may further be adapted to remove the heat produced by the light sources. To this end, the light sources may include heat sinks or heat transfer devices, and the light sources or LEDs are mounted on the heat sinks so as to provide a heat transfer path from the light source to the heat sink (e.g., with thermally conductive contact such as with thermally conductive epoxy or the like). The flame simulator may include a chimney or manifold at the outlet of the fan to direct the fan air flow. When a radial fan is utilized, it may further be useful to include a diffuser or air flow straightener in the chimney such that the fan air flow is relatively straight as it passes over the flame elements. The flame elements are typically formed of a lightweight fabric to have a body formed from a sheet of silk or other fabric. In some embodiments, white silk is used, and the body is formed by cutting a sheet of white silk with a laser to sear or fuse threads at the edges of the body. The edge is preferably further treated with a fray blocking material that forms a solid and weighted edge of a particular thickness (such as less than about 0.07 inches). The flame elements are mounted on the chimney, and the edge of the chimney at the outlet may include pairs of grooves or slots for receiving mounting rods or members that are in turn attached to the base of the flame. The mounting rods in some cases are metallic and magnets are provided on the chimney near to the grooves such that the rods and attached flame elements are retained in the flame simulator by magnetic forces. The grooves and rod/base may be marked with matching or corresponding marks (such as with one or more alphanumerical characters) to facilitate placement of particular flame elements in particular grooves so as to maintain a desired arrangement of the flame elements (such as when the flame element bodies differ in size or shape).

DETAILED DESCRIPTION OF THE PREFERRED EMBODIMENTS

Figure 1:
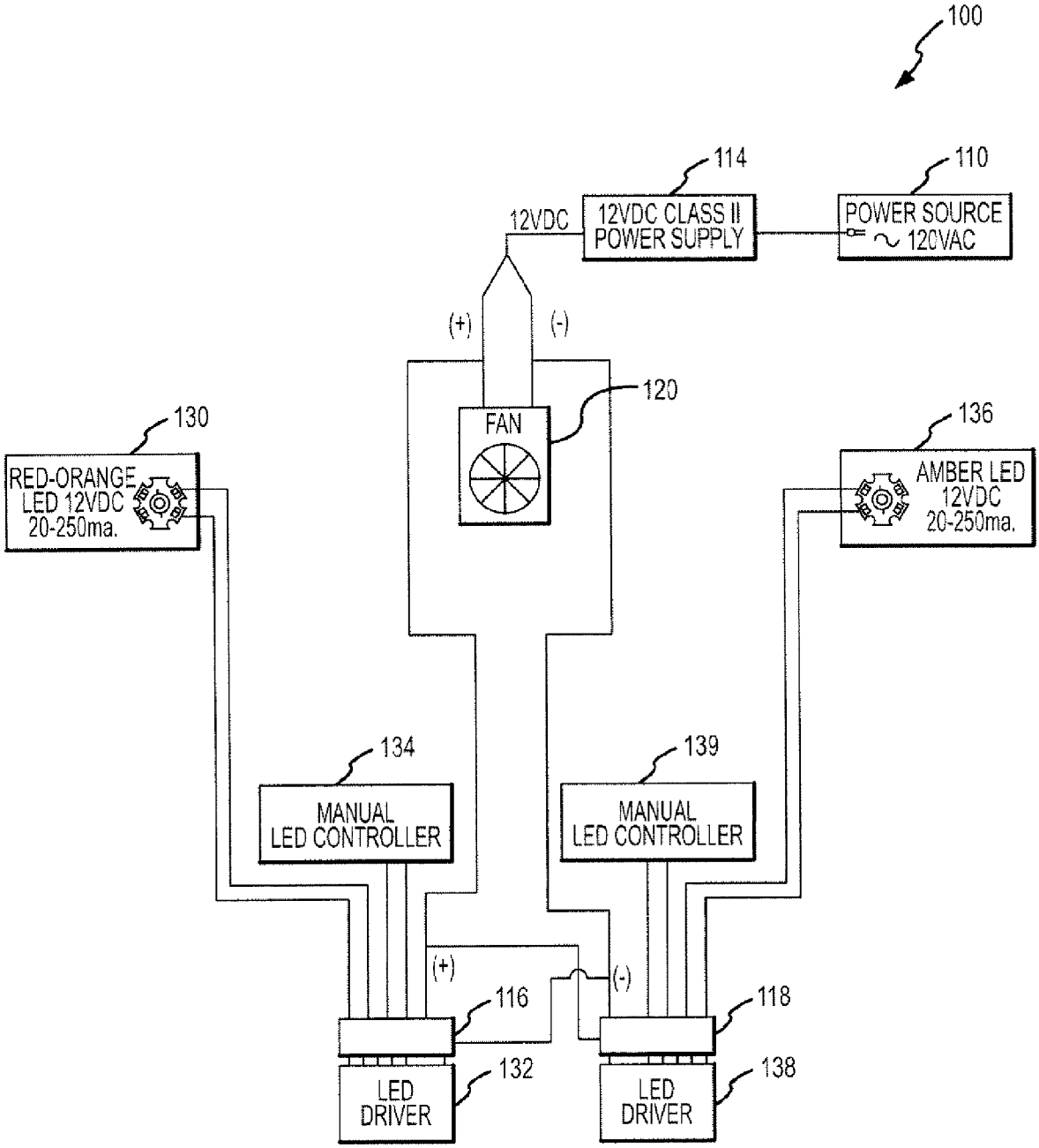
FIG. 1 is a functional block diagram providing an electrical layout for one embodiment of a standalone flame simulator according to the present invention.

Briefly, the present invention is directed to flame simulators that utilize multiple light sources combined with lower capacity fans or blowers to achieve an enhanced visual effect. The flame simulators are useful as standalone devices as they are configured to be switched on and left to provide continuous hours of operation. In some embodiments, the multiple light sources include two or more high powered (e.g., up to about 3 Watts) light emitting diodes (LEDs) that are tuned to provide a desired brightness (e.g., 20 to 70 or more lumens). The LEDs are typically differing colors and the tuning is effective for achieving a desired color when the colored light from the two or more LEDs are mixed. The use of LEDs are desirable for achieving increased hours of service and for controlling unwanted blow-by that may result from using too bright incandescent bulbs. Blow-by is further controlled and the fire effect enhanced by directing the LED-produced light by mounting the LEDs to be directed to meet or cross where flame elements (or their bodies and/or tips) will be located during operation of the simulator and by the use of lenses that better cause the produced light to be concentrated in a desired pattern such as column with a cylindrical, oval, elliptical, or other-shaped cross-section.

The high powered LEDs also produce significantly less heat, and several embodiments further control temperatures within the flame simulators by mounting the LEDs on heat sinks or transfer devices to remove heat in an effective manner. In addition to tuning of LEDs to achieve a desired color result, flame simulators of the present invention may include an LED controller that runs one or more flame simulation routines to alter the brightness of the two or more LEDs on a regular or random time schedule, which produces a varying brightness of the flames found in real fires. The realism of the fire may be even further improved by providing one or more LEDs or other light sources that are caused to flash or be turned on/off at regular or random intervals to illuminate flame elements so as to cause pops or sparks in the flame simulator as is typical of wood and other fuel source fires.

With programming, the light sources can be caused to vary their brightness in a relatively slow and varying pattern while also having one or more flash sources that are turned on and off very quickly (such as in a fraction of a second) to produce a very effective flame illusion when compared with common devices that use a single constant brightness light source.

The flame simulators of the present invention are also configured to produce desirable flame effects by using two or more fabric flames that are adapted for use with the low capacity fans or blowers used in the simulators. For example, the fans or blowers may be common computer or muffin fans that may have an output of less than 50 cubic feet per minute (cfm). In some embodiments, two, three, or more flame elements that are fabricated from relatively thin silk sheet are provided with a pattern selected to produce a desired fluttering pattern. To enhance wear and maintenance, the silk flame elements are laser cut rather than scissor cut to fuse or seal their edges, and a fray resistant material may be applied along the outer edge to further resist fraying of the threads of the flame elements. The flow of the fan is carefully controlled such as with a manifold or chimney with diffusers or flow straighteners such that the air flow over the flame elements is straight or less swirling (e.g., less of a vortex as is commonly output from a computer fan). The flame elements are arranged in a particular pattern selected for their size, for the LEDs being used, for the effect being produced (e.g., a log product, a torch product, an outdoor theme product, and the like), and other variables. This pattern is retained even when the flame elements are removed by providing a mounting assembly that includes grooves or recesses on an upper edge of the flow chimney for receiving a mounting rod provided at or through the bottom portion of the flame element body. The grooves or recesses may be marked with numbers, letters, or other markings that match similar markings on the mounting rods or flame elements such that the person replacing the flame elements can readily identify the correct orientation and location for the replacement part. Further, the mounting rod is formed of a metal that is attracted to magnets and magnets are mounted on the flow chimney adjacent to or proximate to the mounting recesses or grooves such that the mounting rods almost snap into place and are held in place during operation and/or movement of the flame simulator. These and other features of flame simulator embodiments of the present invention are described in more detail below with reference to FIGS. 1-9.

FIG. 1 illustrates one exemplary standalone flame simulator 100 of the present invention, with FIG. 1 providing generally an electrical circuit or layout for the simulator 100 as well as components as functional blocks. As shown, the simulator 100 is connected or plugged into a power source 110 such as a standard 120 VAC source and a power supply 114 is included to supply direct current at levels used by the simulator 100 components (such as, but not limited to, 12 VDC). Wiring and connectors 116, 118 are provided to distribute the power from supply 114 to the various simulator components.

Providing proper lighting is a significant issue addressed by the flame simulator 100. Specifically, the lighting preferably is selected to reduce maintenance by providing long service life while producing desired colors on the flame elements (not shown in FIG. 1 but shown in FIGS. 5-9). Further, the brightness and resulting color preferably should be tunable or settable to approximate a color and brightness of a flame being imitated such as a wood fire, a gas fire, a coal fire, and the like. With this in mind, the flame simulator 100 includes two light sources 130, 136 that provide two differing colors. In one preferred embodiment as shown, the light sources 130, 136 are LEDs and specifically, a red-orange LED 130 and an amber LED 136, which may be high powered LEDs to achieve the desired brightness such as 12 VDC, 250 to 350 or higher mA LEDs such as the Luxeon® Star Power Light Sources manufactured by Philips or the like that are also sometime labeled 3 Watt (or higher powered) LEDs that are capable of up to 70 or more lumens brightness. LEDs are used as light sources 130, 136 in part because they provide adequate brightness and have extremely long service lives (e.g., up to 100,000 hours). LEDs also run much cooler than incandescent lamps. Additionally, LEDs come in a variety of colors that have proven useful in the simulator 100 to produce a desired color or a "flame" color when the LEDs 130, 136 have their illumination or output mixed near or upon flame elements used in the flame simulator 100 (e.g., downstream of the output of fan 120). In one embodiment, one LED 130 is red-orange and the other LED 136 is amber because these colors combine in the simulator 100 to produce a desired resultant or color output on or at the flame elements (i.e., a first color output by LED 130 is combined or mixed with a second color output by LED 136 (with each having the same or differing brightness levels) to produce a third color on or near the flame elements, with the third color differing from the first and second colors).

To further enhance the produced flame effect, the flame simulator 100 includes an adjustable or controllable light source driver 132, 138 for each light source 130, 136. In the illustrated example, first and second LED drivers 132, 138 (e.g., commonly available LED drivers typically paired with particular LEDs) are provided to drive or power the LEDs 130, 136 to set their brightness. Further, operation of the drivers 132, 138 and, in turn, the brightness of the LEDs 130, 136 is controlled by manual LED controllers 134, 139. For example, a potentiometer may be provided for or as part of controllers 134, 139 to set the amount of power that is directed to the LEDs 130, 136 so as to allow an operator of the simulator 100 to tune or set the brightness for each of the light source or LED 130, 136. In this manner, the controllers 134, 139 can be used to tune the outputs of the LEDs 130,136 to achieve a desired brightness for each of the LEDs 130, 136, and in some embodiments, the brightness of the two LEDs 130, 136 will differ to achieve a desired flame color or color output on or near the flame elements. In embodiments, using more than two LEDs or light sources 130, 136 each of the sources may have their brightness adjusted independently in this manner to set the flame color or color output produced by the mixing of the light output by the light sources 130, 136. For example, if high powered LEDs are used for sources 130,136 and have a brightness range from 0 to 70 lumens, the controller 134 may be operated to tune or set LED 130 at 40 lumens while controller 139 may be operated to tune or set LED 136 at a different brightness such as 60 lumens to achieve a desired effect. Prior devices generally did not allow colors to be mixed in this manner and did not allow brightnesses to be adjusted in this efficient way (e.g., allow an effect designer to adjust brightness of each LED 130, 136 after installation to achieve a desired color mix on site or as the device will be used and seen by observers). More commonly, a single incandescent bulb was used to light a flame element and the brightness was fixed or set upon manufacture or only alterable by changing bulbs. As will be discussed with reference to FIG. 4, the LEDs 130, 136 are also preferably mounted so as to allow their output to be adjustable or directable and also with lenses provided to concentrate or focus the output of the LEDs 130, 136 in a desired pattern upon an area or volume through which the flame elements move during operation of the simulator 100.

Providing air flow in a manner that produces desirable flame element movement is another issue addressed by the flame simulator 100. Prior flame simulating assemblies generally used fans that were noisy and large and that had too high of a capacity or produced too much airflow causing the flame element to flap too quickly or to stay relatively straight in the flow path. As discussed below, the inventor selected relatively lightweight flame elements, and, in turn, selected a fan 120 to provide airflow at lower rates and quietly. The selection of the fan 120 may vary with the design of an output manifold or chimney (not shown) and upon the size, thickness/weight, and shape of the flame elements, with it being important to "marry" or match the air flow rate with the flame elements to achieve a desired flame element motion or movement pattern. In a preferred embodiment, the fan 120 is selected to be a typical computer or computer muffin fan as these small radial-type fans produce desired low flow rates (e.g., less than about 50 cfm and often in the range of 20 to 40 cfm), have long, service-free operating lives, and are very quiet.

Figure 2:
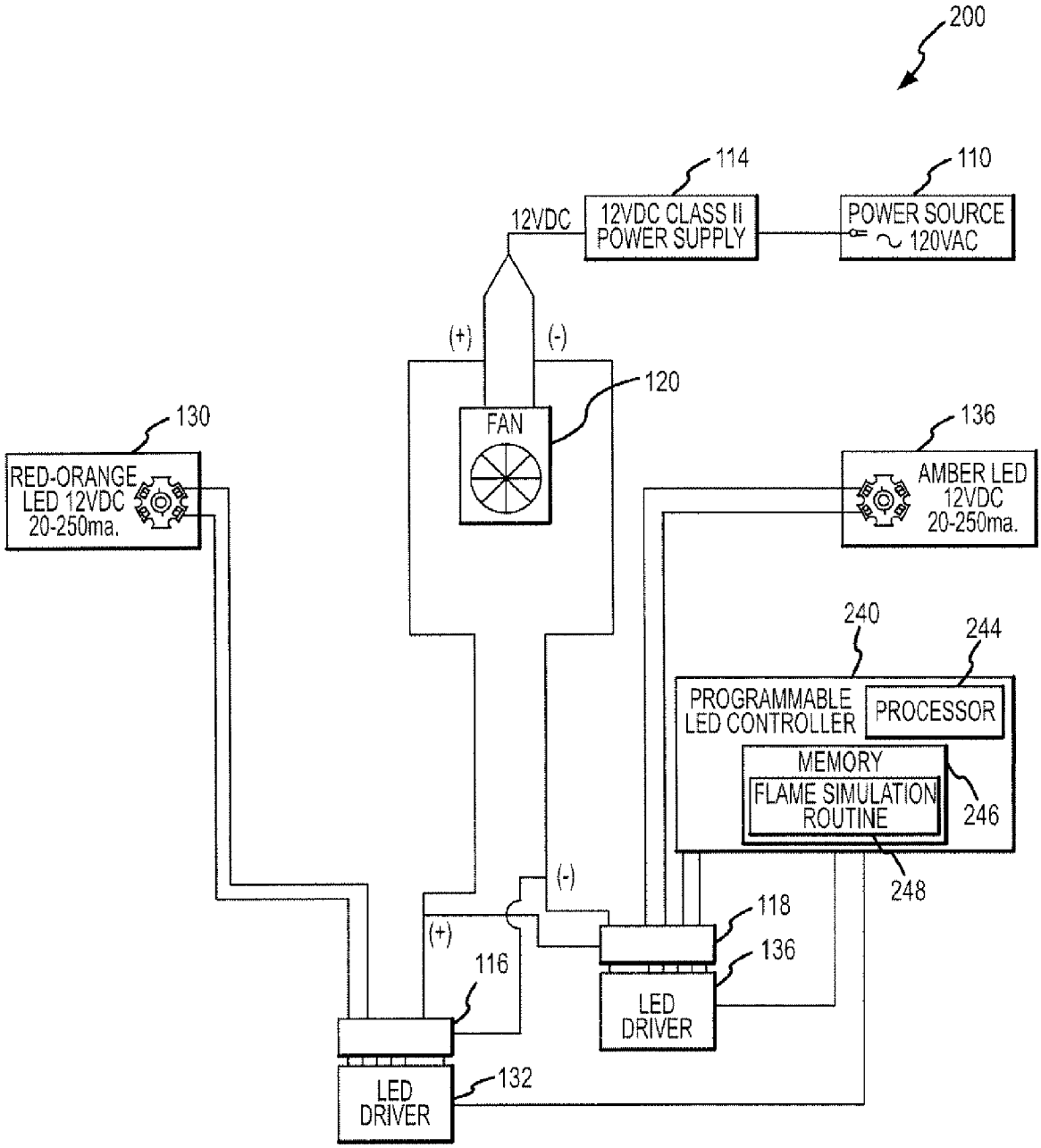
FIG. 2 illustrates a functional block diagram similar to FIG. 1 showing an embodiment of a standalone flame simulator with a programmable controller for the simulator's two light sources.

In some embodiments of the present invention, it is desirable to add "intelligence" to the flame simulators by including an automated controller that acts to tune and change the brightness of one or more of the light sources. One such embodiment of a flame simulator 200 is shown in FIG. 2. The simulator 200 includes a number of the components of the simulator 100 of FIG. 1, and their description is not repeated here. However, in the simulator 200, the manual controllers 134, 139 are replaced with a programmable LED (or other light source) controller 240. In some cases, though, the manual controllers 134, 139 are also included to allow a base or default brightness to be manually set for the light sources 130, 136.

The programmable LED controller 240 is connected to the LED drivers 132, 136 to control their operation and to at least periodically alter the brightness of one or both of the LEDs 130, 136. The controller 240 may take a number of forms to provide the functions described herein and is not limited to a particular physical configuration. In one embodiment, though, the controller 240 includes a processor 244 and memory 246 storing a flame simulation routine or program code 248. During operation of the simulator 200, the processor 244 runs the simulation routine 248 and based on this routine 248, it transmits control signals or otherwise the controller 240 operates to control the LED drivers 132, 136 to set the brightness of the LEDs 130, 136. In one embodiment, the simulation routine 248 is a relatively simple loop routine that causes the brightness of one or both of the LEDs 130, 136 to have its brightness changed such as by slowly increasing its brightness and then returning it relatively quickly or after a period of time to some lower base or default value (e.g., one that was previously manually set to simulate a particular low or minimal flame effect). This programming of the two LEDs 130, 136 can be thought of as washing up and down their brightness levels to add a tremendous amount of realism to a flame effect as this causes the color and/or brightness of the flame to vary as would be the case with a real fire. The routine 248 may be adapted to move brightness of the LEDs 130, 136 up and down concurrently or in unison or it may be adapted to change brightness of only one of the LEDs 130, 136 at a time (or less than all when 3 or more LEDs are used in a simulator), or be adapted to alter the brightnesses independently but concurrently (e.g., one may be increasing while the other is decreasing, one may be increasing or decreasing at a faster rate, or other combinations).

The adjusting of the LEDs 130, 136 by the controller 240 may be in preset patterns that are looped through over and over. In other cases, the routine 248 may be adapted to more irregularly or randomly alter the brightnesses of the LEDs 130, 136. For example, a random number generator routine may be used to randomly select among a number of wash up and down subroutines for one or both of the LEDs 130, 136, with the wash up and down subroutines setting the upper and lower bounds for brightness and the time of such wash up and down (e.g., over 1, 2, 3, or more seconds and whether the brightness is held constant at any point in the subroutine). The number of combinations of the LED adjustments possible by controller 240 is quite large, but an important feature of the simulator 200 is that the LEDs or other light sources 130, 136 have brightnesses or brightness levels that are programmable via routine 248. This allows the flame simulator 200 to act as a standalone device that can be powered on and continue to operate for long periods of time to produce a flame effect that varies over time (e.g., in cyclic or random patterns).

In other embodiments, the controller 240 may be connected to a remote control device (not shown) to receive control signals to operate the LED drivers 132, 136 in a particular manner such as in response to an outside event as may be the case for an amusement park ride. Alternatively, the remote control device may download a new routine 248 for running by the processor 244 or otherwise modify/update the routine 248. In still other embodiments, the simulator 200 may include sensors (not shown) whose input is utilized to select when to run the routine 248 or when to run a portion of the routine 248. For example, a light sensor may be provided to determine levels of light at the location of the simulator 200, and when certain light levels are sensed, the routine or portions of the routine 248 may be run to vary the effect produced by the simulator 200. Also, motion sensors may be used to detect motion and when such motion is sensed, operate the routine or portions thereof to operate the LEDs 130, 136 in a different manner to achieve a desired and responsive effect (e.g., get brighter or dimmer or more variable when an individual walks past the simulator 200).

Figure 3:
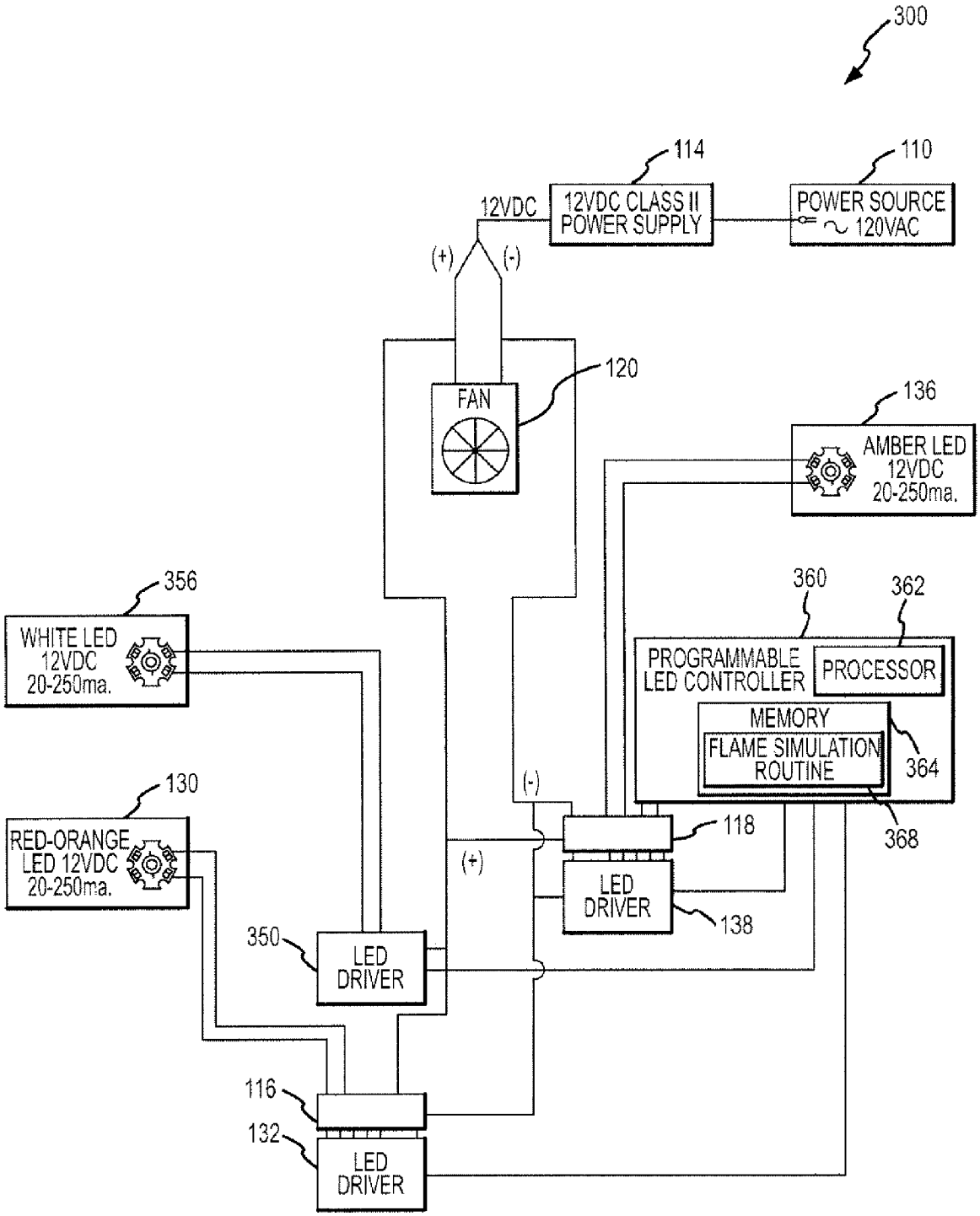
FIG. 3 is a functional block diagram similar to FIGS. 1 and 2 showing another embodiment of a standalone flame simulator in which a third light source (e.g., an LED) is provided and controlled by a programmable controller.

In other embodiments, it is desirable to provide at least one light source that strobes or flashes to provide the spark or intermittent pop or crack that is common in many fires. FIG. 3 illustrates another flame simulator 300 of the present invention that builds on the configurations shown in FIGS. 1 and 2 but includes a third light source 356. The source 356 may be a white or colored (e.g., amber or other color) LED such as a high powered LED and an LED driver 350 may be provided to drive the source 356. The source 356 is operated in this embodiment by a programmable LED controller 360 that includes a processor 362, memory 364, and a flame simulation routine 368. The routine 368 is run by the processor 362 and provides the timing of strobes or on/off switches for the third LED 356 (e.g., strobed on and off in a fraction of a second so as to flash quickly). The routine 368 may be adapted to provide the strobe control signals for LED 356 at regular intervals, but more preferably, the LED 356 is strobed or flashed at irregular and unpredictable intervals to more closely simulate the unpredictable nature of flames in a real fire (e.g., to imitate the surprising pop or snap of burning logs). Further, the brightness of the strobe or flash preferably varies to better imitate a real fire (e.g., to imitate the louder snap of a knot in a log catching fire or reaching a certain temperature).

The first and second LEDs or light sources 130, 136 may have their brightness tuned and maintained such as with the use of a manual controller. Or, as shown the LEDs 130, 136 may also be controlled to have their brightness change over time as was described with reference to simulator 200 of FIG. 2. The adjustment of the LEDs 130, 136 may be handled by the routine 368 independently of the third LED 356 or the routine 368 may be written to have the brightness of one or both the LEDs 130, 136 vary immediately before or after the strobe or flash of LED 356. In this manner, the mixing of the brightness and colors of the three LEDs 130, 136, and 356 may be controlled to more effectively simulate a real fire with its changing brightness and varying colors or color shades. The drivers 132, 138 and use of LEDs 130, 136 supports providing a programmable flame simulator 300. During exemplary but not limiting operation, the white, amber, or other color LED 356 is strobed with irregular pulses to imitate the strobing or flickering of an actual flame.

Figure 4:
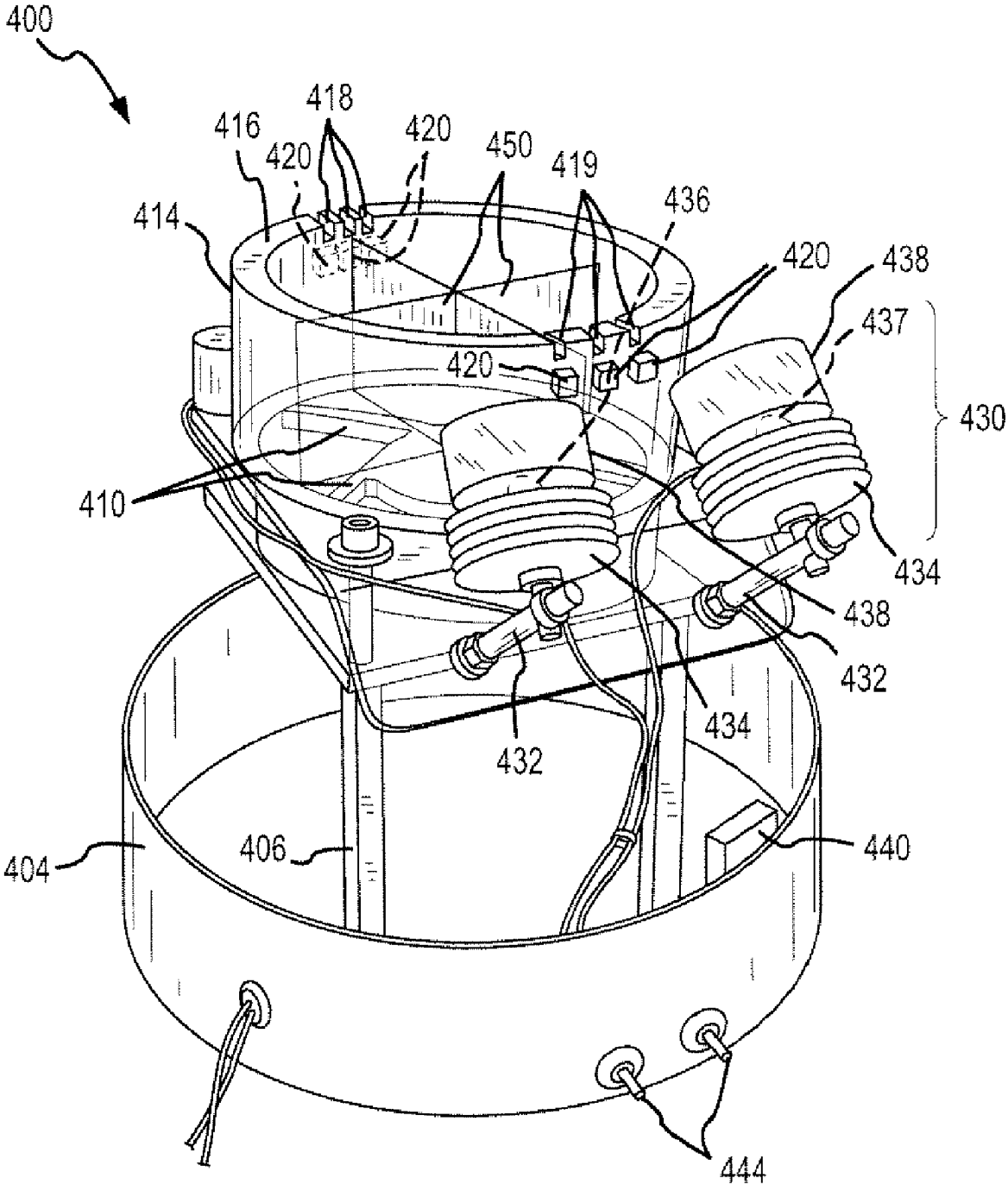
FIG. 4 illustrates a perspective view of flame simulator of the present invention without its outer housing and without flame elements.

FIG. 4 illustrates a view of standalone flame simulator 400 of the present invention. For example, the simulator 400 may be used to implement the simulators 100 and 200 or the simulator 300, with modification to include a third LED. The simulator 400 is shown without flame elements and without an optional outer housing or shell, but these may take the forms shown in FIGS. 5-9. As discussed, the simulator 400 is configured for causing flame elements to move in a realistic fashion with air flow and a mounting arrangement and with an enhanced lighting source or sources (e.g., a lighting assembly).

As shown, the simulator 400 is compact and includes a base 404 through which power and/or control wiring may be provided. Supports 406 extend out from the base 404 and a fan 410 is mounted on the supports 406. In some cases, a support plate or other structures may be provided to facilitate mounting of the fan 410. A number of fans or blowers may be used for the fan 410, and in some embodiments, a standard computer or computer muffin fan is used for the fan 410. The fan 410 in these embodiments typically will be a relatively low flow or capacity fan with an output of less than about 50 cfm such as about 40 cfm (or 20 to 40 cfm or the like). Such low capacity fans are useful for moving the flame elements of the present invention in a desired manner (e.g., slower wave-like motion) while being quiet and not causing excess airflow near the simulator 400 outlet. Computer fans are also desirable because they are designed for long and continuous service.

An air flow manifold or output chimney 414 is provided at the outlet of the fan 410 to direct the air flow to flame elements and to provide a mounting location for the flame elements. Computer fans are typically radial fans, and hence, the output of fan 410 often will have a vortex or tornado-like air flow or output at the top edge or outlet port 416 of the chimney 414. This will often result in an undesirable movement pattern for the flame elements. To straighten the flow from fan 410, a pair of flow straightener plates or diffusers 450 are provide within the chimney 414 as shown in FIG. 4. As shown, the diffusers 450 have a "T" or "X" cross sectional shape relative to the axis of the fan 410. Other straightener arrangements may be used to practice the invention as long as they function to remove or at least reduce the spinning or vortex produced at the outlet of radial fan 410. In one embodiment, the chimney 414 is formed from a section of an acrylic or plastic tube and the diffusers 450 are planar members also formed from acrylic or plastic that are connected to each other with mating slots. The chimney 414 may vary in length and width but generally functions to direct the flow to the flame elements, to provide a mounting location for the flame elements, and to provide a housing for the diffusers. In one embodiment, the chimney has a length in the range of about 1 to 6 inches and has an inner diameter equal to at least about the diameter of the fan 410 outlet (or about 3 to 5 inches in inner diameter).

Figure 9:
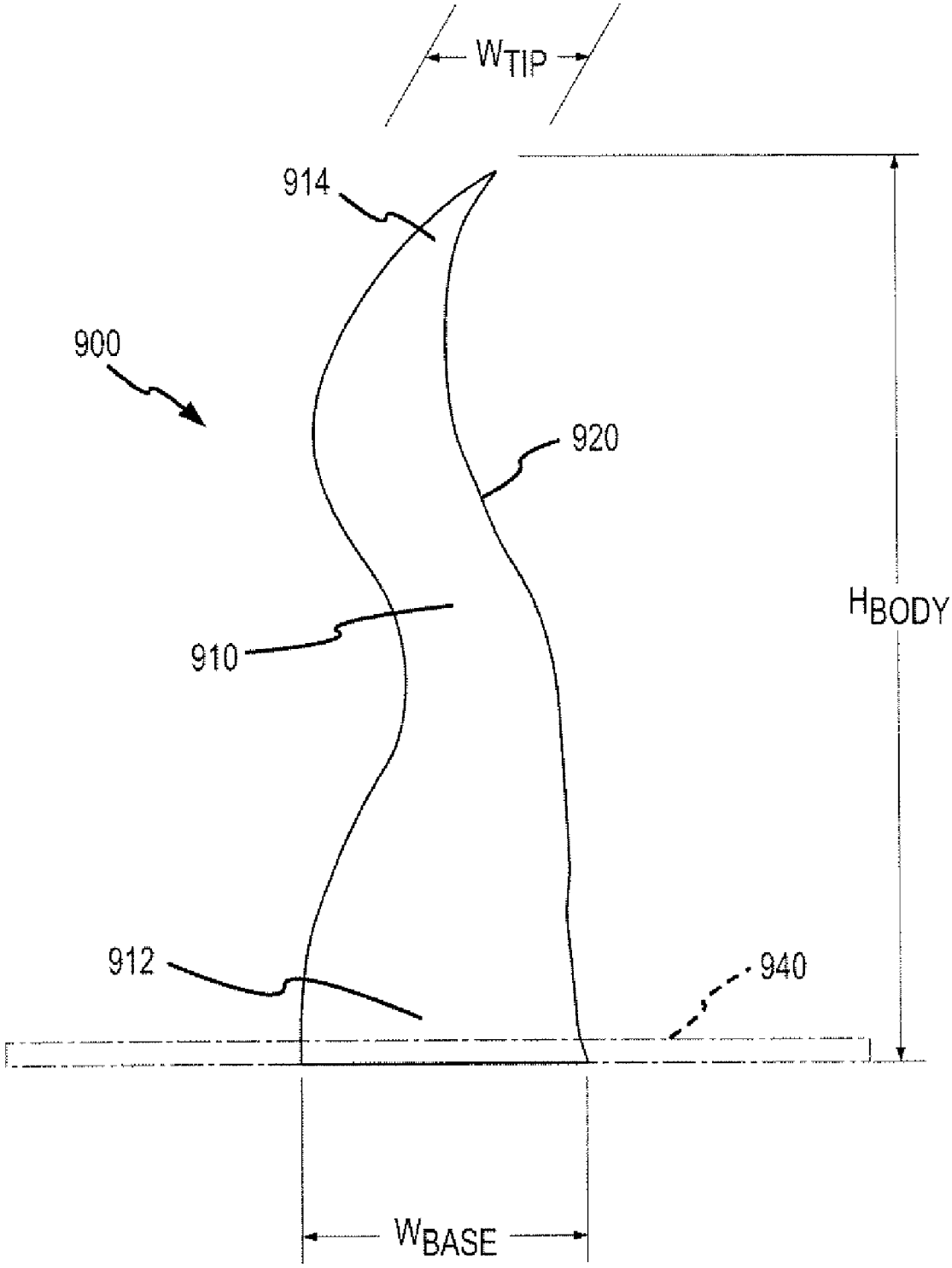
FIG. 9 illustrates an exemplary flame element or sheet for use in the flame simulators of the present invention.

As discussed above, the mounting of the flame elements is typically provided for in the simulator 400 so as to both make it easy for maintenance personnel to replace the flame elements without changing their mounting location and/or their orientation and to retain the flame elements in their location during operation and use of the simulator 400. To this end, the chimney 414 includes a pair of grooves or recessed surfaces 418, 419 in the top edge 416 for each flame element. The flame elements, as shown in FIG. 9, are preferably provided with a mounting rod or member at their bases, and this rod is generally metallic to be susceptible to magnetic forces. The grooves 418, 419 may be marked with letters, numbers, and/or other symbols as are the mounting rods or the base portions of the flame element bodies so that a flame element can readily be inserted onto the top edge 416 of the chimney 414 by matching these mounting symbols. This minimizes the risk that flame elements with intentionally differing configurations or shapes would be misplaced during maintenance, which could ruin or detract from the resulting flame effect. A single magnet may be provided near the top of the chimney 414 or as shown, a magnet 420 may be provided (e.g., glued with an adhesive such as Loctite or other adhesives useful for attaching metal/magnets to plastic and other materials or otherwise rigidly attached to the interior or exterior of the chimney 414) adjacent or proximate to each groove 418, 419 so as to attract and "hold" the mounting rod in the groove or slot 418, 419. For example, the connection rod may be a copper or other ferro-magnetic rod (e.g., a 0.0625-inch welding rod or the like) and the magnets 420 may be neodymium magnets (e.g., a strong rare earth magnet per unit size). The chimney 414 with its slots 418, 419 and magnets 420 may be considered a mounting assembly for the flame elements in addition to providing the function of air flow control for fan 410.

The simulator 400 can also be considered to include a lighting assembly 430. The assembly 430 includes a pair of mounting arms 432 extending out from supports 406 (or a support plate at the top of supports 406). The mounting arms 432 are preferably selected to be adjustable such that a light source mounted on the arms 432 can be manually positioned to direct its output in a particular direction or at a desired angle. On the support arms 432, a heat sink or heat transfer element 434 is provided, and it is typically mounted so that it can be rotated about the axis of the support arms 432 to further enable an operator of the simulator 400 to accurately focus the light sources 436, 437 at a desired location above the top edge 416 of the chimney 414. An LED 436, 437 is mounted on the top of each heat sink 434. The LEDs 436, 437 may be high power LEDs of differing color, and, as discussed with reference to FIG. 1, the LEDs 436, 437 put out heat. The heat sinks 434 are fin-type radiators but other configurations may be used (such as LED heat sinks manufactured by AAVID Thermolly and distributed by F.A. Electronics). These heat sinks 434 are generally formed of a heat conductive material such as a metal and the fins are provided to expose a large surface area to air flowing adjacent to the heat sinks 434. To further enhance heat rejection from the simulator 400, the LEDs 436, 437 may be mounted directly to the upper fin of heat sinks 434 or with a thermally conductive epoxy or the like (such as an LED epoxy compound) to the heat sink (e.g., to provide relatively large and continuous mating surface between the LEDs 436, 437 and the heat sinks 434). In prototypes of the simulator 400, it was found that the temperature of the heat sinks 434 and components surrounding the LEDs 436, 437 was kept at ambient or only slightly higher, whereas without the heat sinks 434 the temperature would likely have been significantly elevated (e.g., "hot" to the touch). This makes the simulator 400 safer to use relative to many prior flame simulators and also increases the service life of the LEDs 436, 437.

It is also important for effective mixing of the beams or outputs of the LEDs 436, 437 for their outputs to be directed to a mixing area or volume (or mixing location) in which the flame elements are expected to be moving during operation of the simulator 400. This is achieved in part by adjusting the mounting arms 432 and/or the heat sinks 434 such that the beams or output light streams from the LEDs 436, 437 cross at a desired spot or location near the top edge 416 of the chimney 414 (such as a spot generally on or near the central axis to the chimney 414 and a distance from the edge 416, e.g., 2 to 6 inches or more above the edge 416 depending on the size or length of the flame elements and the size of the output beam from LEDs 436, 437). Further, the output beams from the LEDs 436, 437 may be reshaped to increase mixing and to mitigate blow-by. As shown, lenses 438 are provided over the LEDs 436, 437 to shape the light beam from each LED 436, 437 into an oval cross-section beam, but, of course, other lenses may be used to focus the output of the LEDs 436-437 into a more condensed or concentrated beam to control blow-by such as lenses with a circular cross section output or the other shapes. One embodiment uses 10°×40° oval lenses for lenses 438 to shape the light beams from the LEDs 436, 437, but other oval lenses may also be used. This embodiment provided an improved focusing of the light from the light sources onto the relatively vertical shape of the flame elements near the chimney edge or outlet port 416 (or to a location or area through which the elements move during operation of the simulator 400). The simulator 400 also includes light assembly control elements shown in FIGS. 1-3 including LED drivers 440 (e.g., a 700 ma. driver manufactured by LED Dynamics or the like) and potentiometer (e.g., an LED dimmer) or manual control knobs 444 (with wiring not shown in FIG. 4 for simplicity of illustration but can be seen in FIGS. 1-3).

Figure 5:
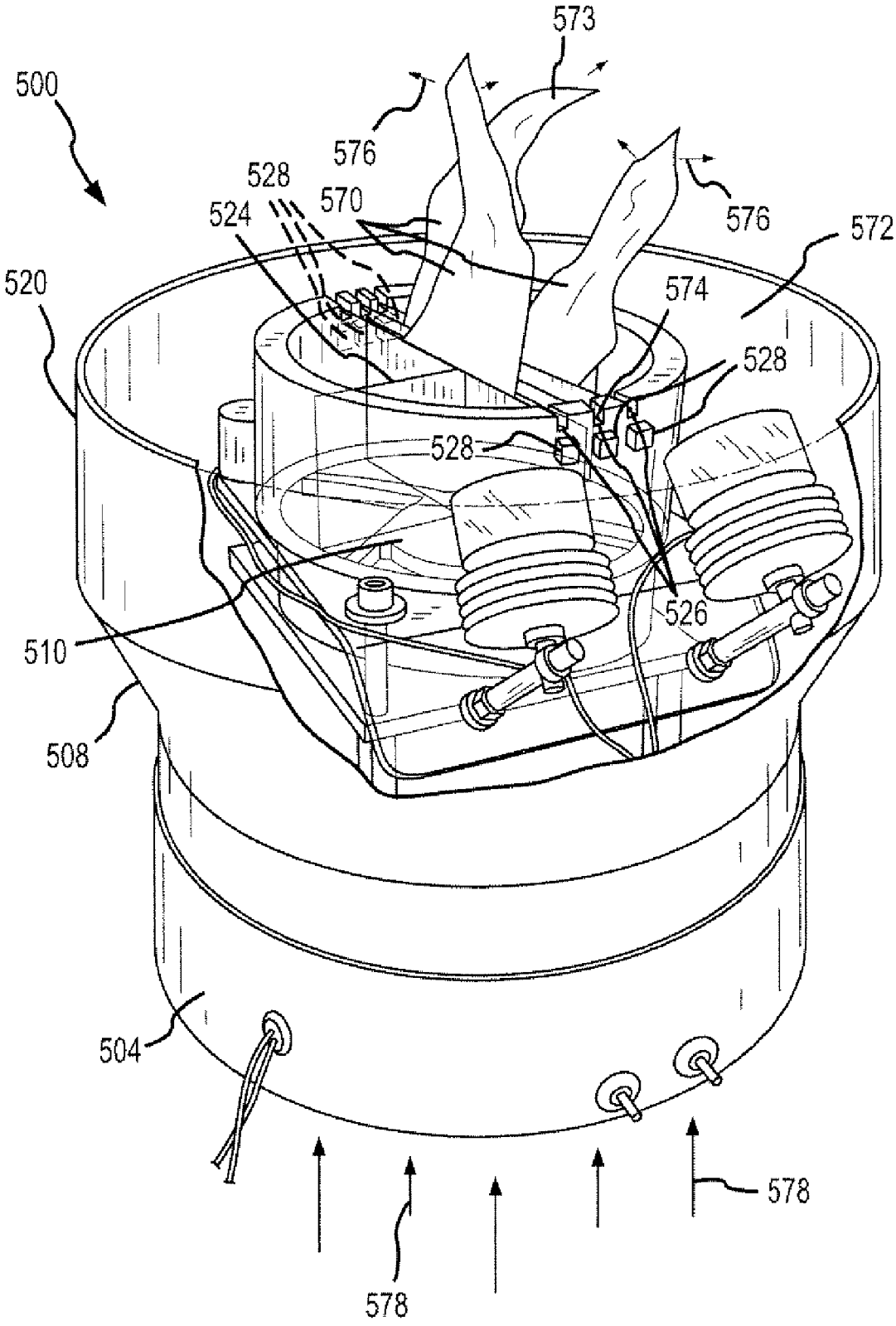
FIG. 5 is a perspective view of an operating standalone flame simulator of the present invention including an outer housing or shell and installed flame elements with the housing partially cutaway to show the fan, the chimney or air manifold, and the flame elements and the associated method of mounting.

FIG. 5 illustrates a standalone flame simulator 500 as it would appear during operation. The flame simulator 500 may be configured similarly to simulator 400 and as shown includes a base 504, a fan or blower 510, and a chimney or fan outlet manifold 520. The chimney is shown also to include mounting slots or grooves 526 and adjacent or near each of these grooves 526, a magnet 528 has been mounted on the exterior of the chimney 520. To straighten or modify the air flow 578 from the fan 510 a pair of diffusers or flow straightening elements 524 have been provided within the chimney 520.

In contrast to the simulator 400, the simulator 500 is shown to include a housing or shell 508 that is mounted on the base 504. The housing 508 generally is used to enclose and protect the simulator 500 components. However, the housing 508 also contributes in smaller amounts to hiding the light sources (not shown in FIG. 5 but may be similar to those shown in FIGS. 1-4) and fan 510. The simulator 500 may be used "as is" to create a flame effect or be inserted into or mounted onto additional structure to provide a specific theme effect such as within a burning log, in a torch structure, and the like. When used "as is," the housing 508 is useful for blocking the view of an observer to the mounting of the flame elements 570 and only providing visibility to a select portion of the elements 570 during the simulator's operation, e.g., a view of the tips or top portions 573 of the elements 570. Often, it is upon this portion of the flame elements 570 that extend outward beyond the housing 508 in the air flow 578 from the fan 510 that the LEDs or other light sources are directed. In other words, the beams or outputs from the LEDs or light sources are focused or directed outward from the housing so as to cross or mix above the upper lip of the housing 508 in an area or volume where the tips 573 or more of the flame elements 570 flutter and flap. In this manner, the simulator 500 is operable to achieve an effect simulation of real flames.

The flame elements 570 include a body with a base portion 572 and a tip or top portion 573. In or on the base portion 572, a mounting rodor member 574 is attached or provided (such as slipped through a sleeve sewn or provided in the base portion 572). The flame elements 570 are arranged in the simulator 500 by inserting the rods 574 into the mounting slots 526 where the magnets 528 attract the copper or other metallic material rods 574 to hold them in place. Again, the rods 574 and/or base portions 572 are preferably marked so that this marking can be paired with a matching (and in some cases, identical) marking on or near the slots 526. The flame elements 570 may be arranged on the chimney 520 such that they are parallel but in some preferred embodiments, the flame elements 570 have their mounting rods not parallel (e.g., the slots 526 on one side of the chimney 520 are closer together than on the other side such that the flame elements 570 are angled toward each other or away from each other as they approach the sides of the chimney 520). The arrangement of the flame elements 570 may vary to practice the invention but the use of non-parallel flame elements 570 in simulator 500 has been proven to produce a more visually effective illusion of flame. Further, it is typically preferable that the mounting rods 574 be placed close enough together (i.e., the distance between adjacent ones of the rods 574 limited) such that the flame elements (and, especially, the flame tips 573) are able to contact each other (at least intermittently) during operation of the simulator 500. Hence, with the use of lower capacity fan 510 the flame tips 573 are able to contact other ones of the flame elements 570 and in some cases will overlap or flow by each other as the flame elements 570 flutter side-to-side as shown at 576 or are shaped to have a wave cross section by the air flow 578. The amount of the flame elements 570 that extends beyond the lip or edge of the housing 508 may also be varied to practice the invention such as to simulate differing fires or fuel sources that may have different sized flames. For example, but not as a limitation, 2 to 8 inches or more of the flame element 570 may extend beyond the lip or edge of the housing outlet or opening in or near the fan's airflow 578, with several preferred embodiments having 3 to 5 inches exposed to provide a "canvas" for mixing of the beams or outputs from the LEDs or other light sources.

Figure 6:
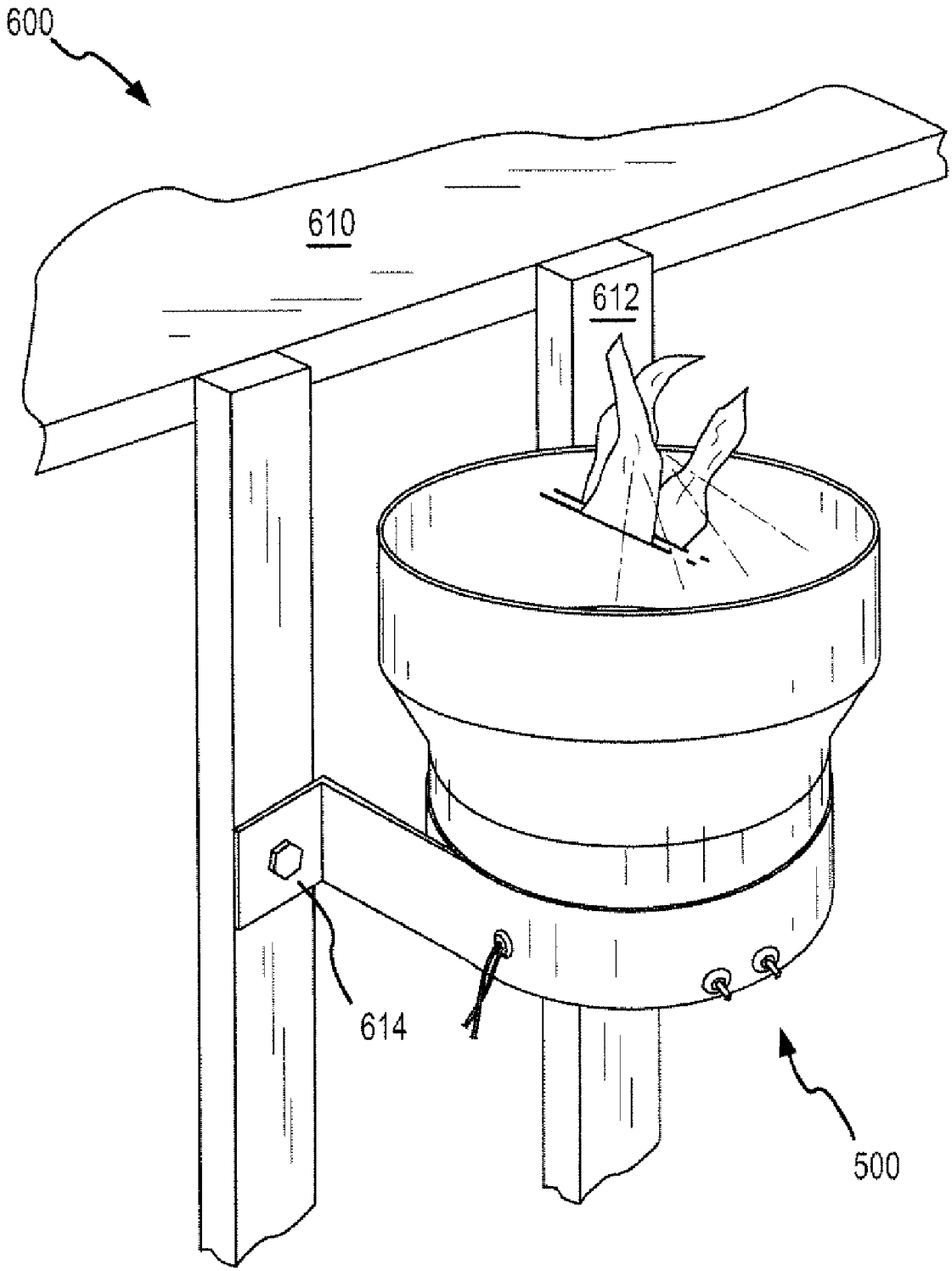
FIGS. 6-8 illustrate exemplary products incorporating flame simulators of the present invention including a burning structure, burning logs such as would be used in a residential fireplace, and a torch that may be used either residentially such as for outdoor or indoor theme lighting or commercially such as for ride special effects, for outdoor lighting, and for other applications.

In addition to the basic standalone flame simulators shown in FIGS. 1-5, the flame simulating features of the present invention may be implemented in a number of assemblies or products. For example, amusement parks often use flame simulators in rides or in displays. Any of the previously discussed flame simulators may be incorporated in such displays either with or without additional structure. FIG. 6 illustrates one flame simulator assembly 600 that incorporates the flame simulator 500 of FIG. 5 to produce a flame special effect. Specifically, front and rear structural elements 610, 612 (e.g., wooden structures such as planks, logs, or the like) are mounted in front and behind/above the simulator 500. The simulator 500 may be provided as a separate or unattached device or may be mounted, as shown, with a bracket 614 or otherwise to one of the structural elements 610, 612 (e.g., is shown attached to the front structural element 610 in this case). The front structural element 610 is shown to block the sight line to the simulator housing with only the flame elements and beams of light being visible to an observer on the distal side of the element 610. The method of mounting and displaying the flame simulators of the invention (such as simulator 500) may vary from that shown in FIG. 6 and include other applications such as wall-mounted torches, hand-held torches, fireplaces, and many other objects and structures that will be apparent to those skilled in the art.

Figure 7:
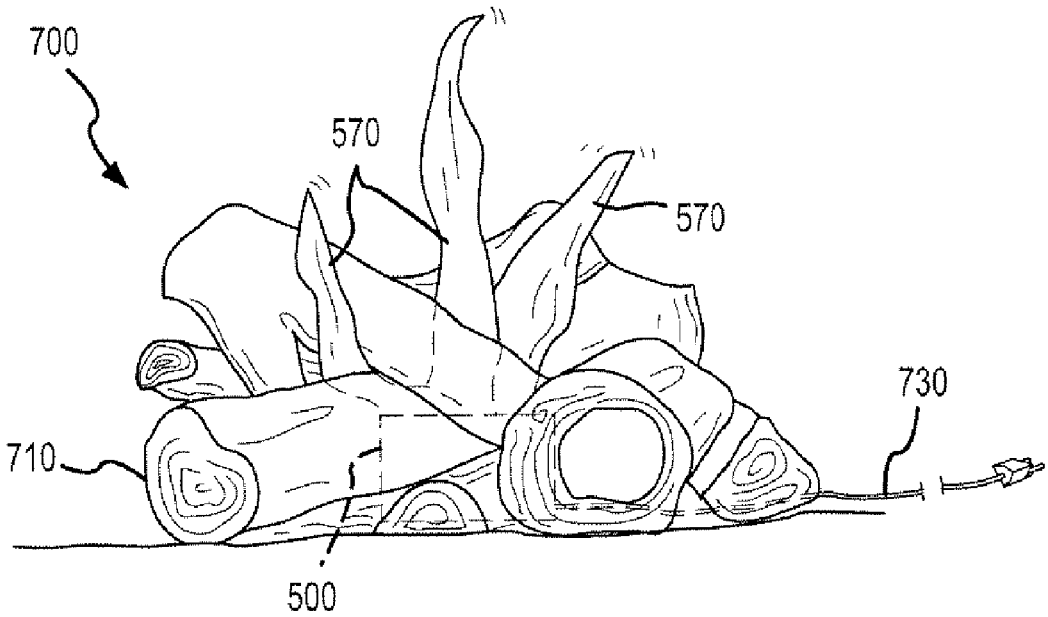
Figure 8:
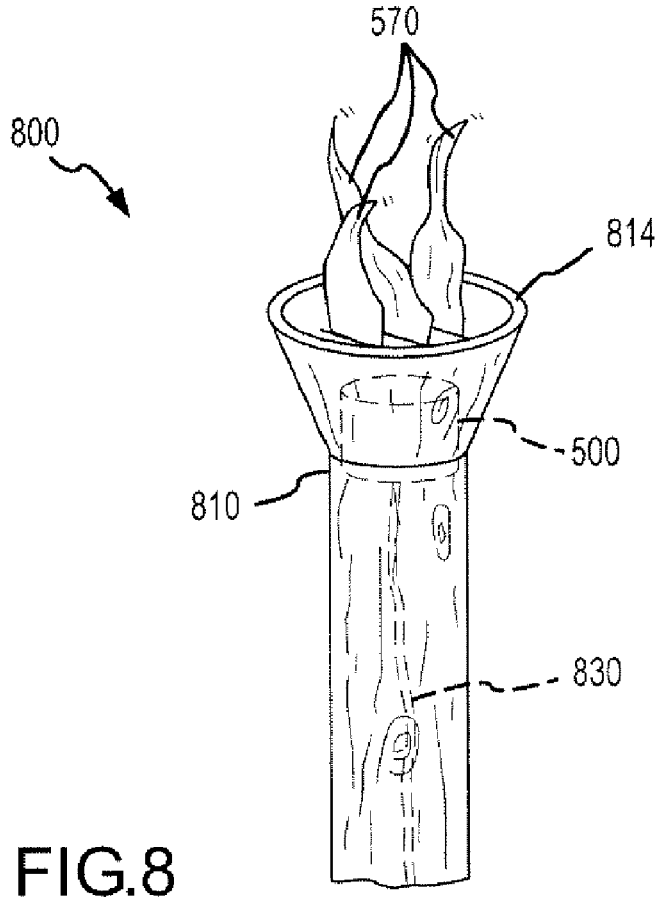

In addition to commercial products, there are many consumer or residential applications for the flame simulators of FIGS. 1-5. Themed lighting is a growing industry with consumers increasingly demanding high quality flame simulators that produce realistic flame effects but that are safe and quiet. FIGS. 7 and 8 illustrate a couple examples of flame simulating assemblies 700, 800 that may incorporate one of the flame simulators of FIGS. 1-5 or a modified simulator based on such simulators. FIG. 7 illustrates a log-based flame simulating assembly 700 such as may be displayed in a fireplace or other residential location. A power cord 730 extends outward from the simulator 500 to allow the assembly 700 to be plugged into a standard electrical socket. The simulator 500 is inserted within or placed behind the log structure 710 such that its flame elements 510 (or a tip portion) are visible with the light from the simulator's light sources. FIG. 8 illustrates a torch or lighting fixture 800, such as may be used for outdoor themed lighting. The torch 800 has a body or torch structure 810 with an opening or port 814. The flame simulator 500 is placed inside the torch structure 810 (with or without the base and/or housing components). Wiring 830 extends from the simulator 500 to allow the simulator 500 to be powered with standard electrical wiring. The simulator 500 is typically positioned within the torch structure 810 such that the flame elements 570 at least partially extend above or out of the opening 814 when the simulator 500 is operated (e.g., when the fan is powered on). The assemblies or products 700, 800 are only representative, and the simulators of the present invention may be used in many other consumer or residential products or applications.

The design of the flame elements is also a significant feature of the simulators of the invention in creating a desirable effect and of also improving the service life of the simulators such as the flame elements 570 of FIG. 5. FIG. 9 illustrates one preferred shape and configuration of a flame element 900 that may be used in the simulators and assemblies of FIGS. 1-8. The flame element 900 includes a body 910 with a base or base portion 912 to which a mounting rod or member 940 is attached such as with a fabric adhesive or is passed through a sleeve as is common for use with tent poles and other fabnc structures. The flame body 910 is preferably formed of a fabric or cloth, but some embodiments may utilize plastic sheets, thin metal foils, and/or other materials. In a preferred embodiment, the body 910 is formed from silk sheet or silk-like sheet (e.g., lightweight translucent fabrics with silk-like luster and drape in silk and/or easy care polyester (i.e., poly silk)) such as white China Silk with a flame retardant (FR) coating fabricated by Dazian (e.g., distributed by West Coast or other distributors). The silk, poly silk, or other material sheet may be colored with one embodiment using a white silk sheet for the body 910, and the particular thread count and/or weight of the sheet may be varied to practice the invention. The use of silk or silk-like sheet for fabricating the body 910 was found desirable for providing a sheen, softness, and light weight that supports the lifting of the body 910 when in an air flow and a realistic took and fluttering or waving motion. With lower capacity fans of the invention, some materials can be relatively heavy and produce a less desirable flame simulation (e.g., not quite as realistic flame flicker and shape).

The shape of the flame body 910 is also important for achieving an effective flame simulation. The inventor experimented with numerous shapes until determining the shape shown in FIG. 9 provided one desirable configuration. As shown, the body 910 has a base 912 with a width, $w_{BASE}$, and a tip or top portion 914 with a width, $w_{TIP}$. Additionally, the flame body 910 has a height, $H_{BODY}$. In some preferred embodiments, the base width, $w_{BASE}$, is chosen to be relatively wide relative to the top portion width, $w_{TIP}$, as the inventor determined that this provided an enhanced "lift" and/or movement of the tip 914 in the air flow or current. For example, the base 912 may be about 1.5 to 2.5 inches wide while the top portion 914 may be 0.5 to 1 inches wide when the body has a length of about 6 to 6.5 inches. It is believed these proportions would be useful with bodies 910 that have differing heights, $H_{BODY}$. Additionally, the flame body 910 is designed to better simulate a flame by having a "twist" such that the edge 920 of the body 910 includes a recess or concave portion on each side of the body 910. Further, it has proven useful to create the twist to provide one in or near the tip 914 and one above the base 912 in the more central portion of the body 910. In this regard, the recesses in edge 920 may be considered to be on opposite sides of the body 910 and offset (i.e., typically not directly opposite). The combined design features of the flame element 900 produce a flickering movement when the element 900 is positioned within an air flow at a fan output as the thinner and lighter tip 914 moves more and in a "whipping" or fluttering pattern relative to the base 912.

The flame 900 is also adapted for a longer, safer service life. In one embodiment, the flame is treated with a flame retardant solution to reduce fire risks. The body 910 is cut from a larger fabric sheet, such as a white China silk sheet, with a laser rather than a scissor or blade. This or other cutting techniques are used so as to sear and/or seal the edges 920 to prevent or at least reduce unraveling of threads in the fabric of the body 910 as was common during use of other flame elements. The edges are further treated with one or more materials (such as adhesive or the like) that function to block or slow fraying of fabric edges. In one embodiment, the treatment material is JT-371 Frey Block available in fabric stores. This material was also selected because it adds less weight to the edge 920 relative to other fray resistant materials or seam/edge treatments. The treatment material preferably is applied to the edge 920 and forms a solid cast that further increases the life of the flame. This solid cast edge 920 also weights the edges 920 of the flame element 900 such that the fabric at the edges 920 is heavier than the body 910 (e.g., the portions of the body 910 interior to or surrounded by the edge 920), and this weight needs to be considered in selecting the shape of the body 910, the size and dimensions of the body 910, and the material used for the body 910 (e.g., makes silk or other lightweight fabrics more desirable). The weight is controlled by limiting the thickness or depth of the edge 920, and in one embodiment, the edge 920 has a thickness of less than about 0.1 inches and more preferably less than about 0.07 inches.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. An apparatus for simulating flames, comprising:

a fan producing air flow;

two or more flame elements positioned in the fan air flow; and first and second light sources producing light beams of first and second colors, wherein the first color differs from the second color, the light sources are light emitting diodes, and the first and second light beams are directed to mix on or near the flame elements in the fan air flow, wherein the first and second light sources further comprise a pair of lenses mounted such that the first and second light beams are focused into patterns having cross sections smaller than about a size of the flame elements in the fan air flow.

2. The apparatus of claim 1, further comprising a light source controller setting a brightness level of the first and second light sources, wherein the light source controller operates to modify the brightness level of at least one of the first and second light sources in a periodic or random pattern.

3. The apparatus of claim 2, wherein the light source controller concurrently modifies the brightness level of both the first and second light sources based on a flame simulation routine, whereby washing of the brightness level between first and second brightness levels is automated and varies over time.

4. The apparatus of claim 1, further comprising a third light source producing a light beam directed to contact the flame elements in the fan air flow, wherein the third light source is controlled to operated periodically or randomly to produce the third light beam for a time duration of less than one second.

5. The apparatus of claim 1, wherein the first and second light sources further comprise a pair of heat sinks and the light emitting diodes are mounted with thermally conductive contact with the heat sinks.

6. The apparatus of claim 1, wherein the lenses are oval output lenses.

7. The apparatus of claim 1, wherein the flame elements comprise a body comprising white silk with laser cut edges and wherein the edges are treated with a fray resistant material.

8. The apparatus of claim 1, further comprising an output manifold at an outlet of the fan, wherein the flame elements are mounted on the output manifold distal to the fan outlet and wherein the output manifold comprises an airflow diffuser between the fan outlet and the flame elements to straighten the fan air flow.

9. The apparatus of claim 8, wherein fan is a radial-type fan with a capacity of less than about 50 cubic feet per minute.

10. A flame simulator, comprising:

a fan generating a volume of air flow at an outlet;

a output chimney positioned at the fan outlet, the output chimney comprising a wall for directing the air flow to a chimney outlet defined by edge of the chimney wall;

a light source illuminating an area adjacent the chimney outlet; and flame elements mounted on the edge of the chimney wall, wherein the flame elements each comprise a mounting rod and fabric body comprising a base portion and a tip portion, the base portion being wider than the tip portion and the mounting rod being attached both to the base portion of the body and to the edge of the chimney wall, wherein a distance between adjacent ones of the mounting rods is such that at least the tip portions of adjacent ones of the flame elements are able to contact each other, wherein the light source further comprises a lens mounted such that the light beam is focused into a pattern having a cross section smaller than about a size of the flame elements in the fan air flow.

11. The flame simulator of claim 10, wherein the fabric body comprises silk sheet with an edge treated for a thickness with a fray blocking material.

12. The flame simulator of claim 11, wherein the thickness of the edge is less than about 0.07 inches.

13. The flame simulator of claim 11, wherein the fabric body is cut from the silk sheet using a laser and wherein the body comprises a first recessed portion and a second recessed portion positioned on opposites sides of the body to provide a twist to the body to enhance movement in the air flow.

14. The flame simulator of claim 10, wherein the mounting rods are metallic and wherein the output chimney further comprise a pair of grooves in the edge for receiving ends of each of the mounting rods and magnets provided proximate to the grooves.

15. The flame simulator of claim 14, wherein the grooves are positioned on the edge such that the mounting rods are not parallel.

16. The flame simulator of claim 10, wherein the fabric flame elements comprise white silk, the light source comprises two or more light emitting diodes producing beams of light having at least two differing colors, and the volume of air flow is less than about 50 cubic feet per minute.

17. An apparatus adapted for use alone or with other structure such as torch structures and imitation logs to produce an enhanced flame effect, comprising:

a fan providing a volume of air flow;

a flow manifold for directing the air flow to an outlet of the flow manifold;

flame elements each comprising a fabric body mounted on or proximate to the outlet of the flow manifold such that the fabric body is positioned within the air flow; and a light source assembly comprising two light emitting diodes each producing a light beam with a brightness level and a controller for the light emitting diodes that is operable to adjust the brightness levels, wherein the light beams have differing colors and are both directed at least partially concurrently toward a location near the outlet of the flow manifold, and wherein the light source assembly further comprises a lens associated with each of the light emitting diodes to shape the light beams based on the fabric bodies of the flame elements to mitigate blow-by, wherein the lenses are mounted such that the light beam is focused into patterns having cross sections smaller than about a size of the flame elements in the fan air flow.

18. The apparatus of claim 17, wherein the controller adjusts at least one of the brightness levels to vary over a range of brightness levels at least periodically during operation of the light source assembly in an automated and ongoing manner.

19. The apparatus of claim 18, wherein the light source assembly further comprises an additional light source directing a light beam toward the location and wherein the controller operates to cause the additional light source to cyclically or randomly flash.

20. The apparatus of claim 17, wherein the lenses focus the light beams and wherein the cross sections are oval or circular in shape.

* * * * *